United States Patent [19]

Chang

[11] Patent Number: 4,956,575

[45] Date of Patent: Sep. 11, 1990

[54] FLAT PANEL DISPLAY WITH DEFLECTION MODULATION STRUCTURE

[76] Inventor: Kern K. N. Chang, 91 Adams Dr., Princeton, N.J. 08540

[21] Appl. No.: 327,614

[22] Filed: Mar. 23, 1989

[51] Int. Cl.[5] ..... H01J 29/70

[52] U.S. Cl. ..... 313/422; 313/413; 313/423

[58] Field of Search ..... 313/422, 423, 413

[56] References Cited

U.S. PATENT DOCUMENTS

| | | | |
|---|---|---|---|
| Re. 30,195 | 1/1980 | Anderson et al. | 313/422 |
| 2,795,731 | 6/1957 | Aiken | 315/21 |
| 2,928,014 | 3/1960 | Aiken et al. | 313/78 |
| 2,999,957 | 9/1961 | Schagen et al. | 313/79 |
| 3,772,566 | 11/1973 | Schwartz | 315/27 GD |
| 4,028,582 | 6/1977 | Anderson et al. | 313/422 |
| 4,080,630 | 3/1978 | Marlowe | 358/242 |
| 4,088,920 | 5/1978 | Siekanowicz et al. | 313/422 |
| 4,121,137 | 10/1978 | Credelle | 315/366 |
| 4,126,814 | 11/1978 | Marlowe | 315/307 |
| 4,166,233 | 8/1979 | Stanley | 313/422 |
| 4,654,559 | 3/1987 | Hinotani et al. | 313/422 |

*Primary Examiner*—Sandra L. O'Shea

*Attorney, Agent, or Firm*—Arthur L. Plevy

[57] ABSTRACT

There is disclosed a flat panel display which includes an evacuated display envelope having a flat front wall, a rear wall spaced apart from the front wall having sides of extremely short length compared to the front dimensions of the display. A phosphor screen is provided on the inner surface of the front wall and hence vertical phosphor columns disposed over said inner surface of said front wall. The display employs a single unmodulated electron gun on one lateral side of the display for providing an unmodulated electron beam which beam is bent both vertically and horizontally to impinge in a direction transverse to the front wall and to enter a color modulation means interposed adjacent to the beam as deflected to impinge upon selected portions of the phosphor elements to produce corresponding illumination intensities.

13 Claims, 5 Drawing Sheets

$$\frac{Xmax}{Ymax} = \frac{K}{\tan\theta}$$

$$\frac{Xmin}{ds} = Z\frac{Vo}{AV}\sin 2\theta$$

FLAT PANEL DISPLAY WITH DEFLECTION MODULATION STRUCTURE

FIELD OF INVENTION

This invention relates to a ballistic beam type of flat panel display, and, more particularly, to one in which an unmodulated electron beam from a single gun is deflected for vertical and horizontal scanning of picture elements on a tri-color phosphor screen, and the illumination intensity of the picture elements of the screen scanned by the beam is modulated by a deflection modulation structure interposed in front of the screen.

BACKGROUND OF THE INVENTION

Prior attempts to develop a flat panel display include gas plasma panels, electroluminescent panels, liquid crystal panels, the classic Gabor tube, and the Aiken tube. These attempts have been unsuccessful for a variety of reasons, including insufficient illumination or contrast, low resolution, excessive power consumption, insufficient reduction in tube depth, difficulties in focusing, difficulties in deflection and the complexity and cost of implementing a suitable color display.

The Aiken tube is of interest due to its achievement of a geometrically flat structure using a single, side-mounted electron gun and a matrix of vertical and horizontal deflection elements to deflect the electron beam to the picture elements on a phosphor screen, as shown for example in U.S. Pat. Nos. 2,795,731 and 2,928,014. However, the Aiken tube requires as many horizontal and vertical deflection elements and associated drivers as picture elements for resolution in the respective directions. It therefore suffers a trade-off of size, cost, and complexity against display resolution and focus. These problems make implementation of a color display particularly difficult. Moreover, the matrix arrangement of deflection elements requires that the beam be deflected sharply at right angles in the vertical and horizontal directions, thereby making deflection driving coercive and lowering the focus of the beam.

One variation of the Aiken-type flat panel display is the parallel guided beam structure developed by RCA Corporation. In the RCA flat panel display, a plurality of channels extend in parallel with a screen, and each channel has a beam guide structure which guides a respective beam along the length of the channel. The beams in all of the channels are deflected simultaneously out of the beam guides at selected points corresponding to a series of horizontal line positions. This type of display requires as many beams as picture elements desired for horizontal resolution in black and white operation and three times as many for color operation. In U.S. Pat. No. 4,028,582 of Anderson, the RCA beam guide structure is improved by providing a pair of channel deflection electrodes on opposite sides of the width of each channel which deflect the beam transversely across a line segment of picture elements, thereby allowing a higher line resolution with a reduced number of beams. However, this device still requires a plurality of separate beams, channels, and channel deflection drivers.

Conventional color CRT displays employ three separate electron guns to generate beams which are directed through a shadow mask at different angles to impinge on triads of color phosphor elements forming each picture element. The intensities of the beams are modulated by modulating the output intensities of the beam emitting guns. A relatively high range of beam intensities must be used in order to sufficiently control the downstream illumination of the color phosphor elements by the respective beams. The shadow mask has apertures dimensioned and positioned corresponding to the directions of the respective beams and positions of the color phosphor elements. The widths of the beams are made wider than the apertures, so that the beams can be collimated to the widths of the phosphor elements by the apertures of the shadow mask closer to the target. The portions of the beams which are not passed generate large amounts of heat in the shadow mask, thereby wasting energy and causing thermal stresses in the tube structure.

SUMMARY OF THE INVENTION

In view of the foregoing problems and disadvantages of the prior art, it is a principal object of the invention to provide a flat panel display having a simplified beam deflection structure that allows fine control of the beam and a high resolution display. A particular object is to provide an improved beam deflection structure which deflects or displaces a scanning beam from an electron gun vertically and horizontally through angles which are substantially less than 90 degrees.

A further object of the invention is to provide a CRT display using an unmodulated electron beam source and a color modulation structure interposed downstream close to the target screen which allows fine control of illumination of the picture elements of the display. A particular object is to provide a flat panel color display using a single unmodulated electron beam source and a color modulation structure positioned proximate the target screen which eliminates the use of a shadow mask.

In accordance with the present invention, a flat panel display comprises: an evacuated display envelope having a substantially flat front wall, a rear wall spaced apart in a depthwise direction from the front wall and substantially coextensive therewith, and lateral sides enclosing the space defined between the front and rear walls; a phosphor screen provided on an inner surface of the front wall substantially in one plane having a plurality of discrete phosphor elements formed thereon along columns in respective vertical directions of the screen; a single, unmodulated electron gun on one lateral side of the display envelope for providing an unmodulated electron beam on a first path into the display envelope substantially parallel to the plane of the screen; beam deflection means including vertical deflection means for deflecting the beam incrementally along the vertical direction on a second path to each of the rows in sequence, beam bending means for bending the beam to the horizontal direction, and horizontal deflection means for deflecting the beam on said second path incrementally along the horizontal direction on a third path to each of the phosphor elements of a row in sequence beam bending means for bending the beam to the normal direction, and color modulation means interposed adjacent the screen and being operable to deflect the beam on said third path to impinge on selected portions of the respective phosphor elements to produce the corresponding illumination intensities.

A preferred embodiment of the invention uses a color modulation mesh structure formed with a plurality of vane elements arrayed in a plane, wherein each vane element is disposed in front of a respective one of the phosphor elements and has a pair of electrically conductive vanes which are spaced apart by a predetermined width allotted to the phosphor element, and a modulation control unit which applies selected voltages to the vane elements to establish selected fields between the vanes to deflect the scanning beam to selected positions in said width so that it impinges on selected portions of the respective phosphor elements.

The above-described flat panel structure is readily adapted to a color display by providing each picture element of the display as a grouping of adjacent color phosphor elements, and deflecting the beam and modulating it through the corresponding vanes of the deflection modulation structure so that it impinges on selected portions of each of the respective color phosphor elements. A preferred form of modulation control utilizes the conventional video signal input as the input to the vane elements. The vanes elements are electrically connected together, and are formed by metallic layers evaporatively deposited on a ferrite or a magnetic insulator substrate to create the effect of a distributed inductance in an artificial transmission line, in order to reduce the required signal voltage and power consumption.

As a further feature of the invention, an improved beam deflection structure for the flat panel display comprises: a first deflection plate for deflecting the beam provided from the electron gun on said first path toward a second lateral wall extending in the vertical direction; a vertical reflection plate 22 which is negatively biased to repel the electron beam away from said second lateral wall through a range of reflected angles; an angle displacement structure having a length extending in the vertical direction spaced from said second lateral wall for receiving the reflected beam at a range of respective vertical positions along its length, and for transmitting the electron beam on the second path for a respective one of the horizontal rows of said screen at an angle toward said rear wall of said display envelope; and a horizontal reflection plate provided on an inner surface of said rear wall which is negatively biased to repel the transmitted electron beam away from said rear wall toward said screen across a range of horizontal positions corresponding to the respective phosphor elements of the horizontal row.

A preferred form of the beam deflection structure electrostatically deflects the beam in the vertical deflection region along parabolic trajectories so as to be incident at an angle of about 30 degrees at the angle displacement structure, and the angle displacement structure further displaces the beam electrostatically or magnetically to the horizontal direction. The angle displacement structure is preferably in the form of a series of arcuate vanes in parallel having conductive surface layers which are biased to displace the beam through the desired angles. The alternative angle displacement structure is a cylindrical horse-shoe electromagnet or permanent magnet. Incremental sweep voltages synchronized with the video signal are applied to the vertical and horizontal reflection plates, respectively, to scan the beam to the horizontal rows and to the phosphor elements of each horizontal row. A multiple of electrodes can be provided between the horizontal deflection plate and the screen to direct the reflected beam through the deflection modulation structure toward the respective phosphor elements of the screen.

BRIEF DESCRIPTION OF THE FIGURES

The above objects and advantages and further features of the invention are described in detail below in conjunction with the drawings, of which.

DETAILED DESCRIPTION OF THE FIGURES

Figure 1:
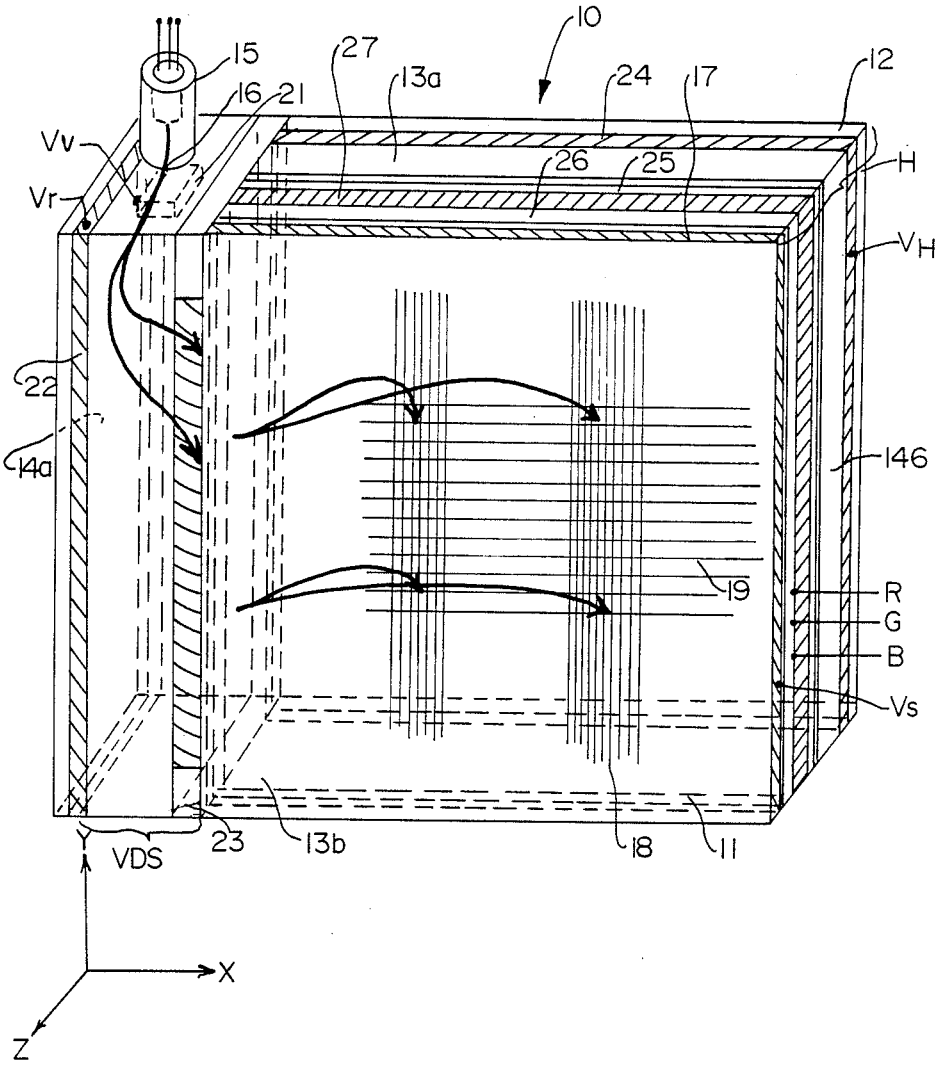
FIG. 1 is a perspective schematic view of a flat panel display in accordance with the invention.

Referring to FIG. 1, a flat panel display in accordance with the principles of the present invention comprises a flat rectangular envelope 10 having a front wall 11, a rear wall 12, and opposing pairs of lateral sides 13*a*, 13*b* and 14*a*, 14*b*. The envelope may be made of glass or other insulative material formed in half-sections which are bonded or welded together. For convenient reference, the vertical direction is taken to be the direction Y, the horizontal direction X, and the depthwise direction Z as indicated in the drawing. In this embodiment, a single, unmodulated electron gun 15 is mounted through an aperture at one end of the upper lateral side 13*a* and provides an unmodulated electron beam 16 into the envelope 10 in a vertical direction parallel to the XY plane.

A phosphor screen 17 is provided on an inner surface of the front wall 11. The screen has discrete phosphor elements which form a columnar array of picture in the Y direction. The phosphor is applied in vertical strips 18 across the surface of the glass front wall 11. For a black and white display one employs instead a single modulated gun and a typical black and white plain surface phosphor. Such phosphors are well known. For color operation, each picture element is associated with a respective triad or grouping of columnar strips 18 of the selected primary colors, e.g. red, blue, and green. The phosphors employed for the color strips are those employed for conventional color tubes. The embodiments described hereinafter refer to the flat panel display as adapted for color operation. Picture element resolution in the vertical direction is determined by the scanning increments of the vertical sweep operation, as described below.

The unmodulated beam 16 introduced into the envelope 10 is deflected by initial deflection plates 21 toward a vertical reflection plate 22 provided near an inner corner surface of the left lateral wall 14*a* and the rear wall 12. A preferred deflection scheme will be given in conjunction with FIG. 10. The vertical reflection plate 22 is biased by voltage $V_r$ so as to repel the electron beam away from the lateral wall 14a and the rear wall 12 along a parabolic trajectory toward an angle displacement structure 23 having its length oriented in the vertical direction. The initial deflection plates 21 have an incremental voltage $V_v$ applied thereto to deflect the beam 16 with an incident angle toward the reflection plate 22, and the beam is consequently reflected toward the angle displacement structure 23 over a corresponding range, as indicated by the upper and lower beam arrows on the left side of FIG. 1. Thus, the beam is deflected by initial deflection plates 21 at a constant incident angle, and the vertical sweep voltages is applied to the reflection plate 22. The preferred range of incident angle is around 30 degrees. The overall effect is a vertical sweep of the beam incrementally over the vertical length of the angle displacement structure 23. The initial deflection plates 21, reflection wall 22 and angle displacement structure 23 together constitute a vertical deflection structure VDS.

The deflection structure will be described in greater detail in regard to FIG. 10.

The beam 16 scanned through the vertical deflection structure VDS is transmitted along a horizontal line in sequence. The transmitted beam exits the angle displacement structure 23 directed at an angle toward a horizontal reflection plate 24 provided on an inner surface of the rear wall 12. The horizontal reflection plate 24 is biased by horizontal sweep voltage $V_h$ so as to repel the electron beam away from the rear wall 12 along a series of parabolic trajectories toward the screen 17, in order to scan each horizontal row of picture elements. The horizontal reflection plate 24 and a horizontal entrance plate 25 constitute a horizontal deflection structure HDS. A similar angle displacement structure 27 bends the beam and directs it perpendicularly toward a deflection modulation structure 26 which is positioned proximate the screen 17 and operates to aim the beam at a selected portion of the phosphor element associated with each respective picture element in order to modulate the illumination level of the picture element.

Figure 2:
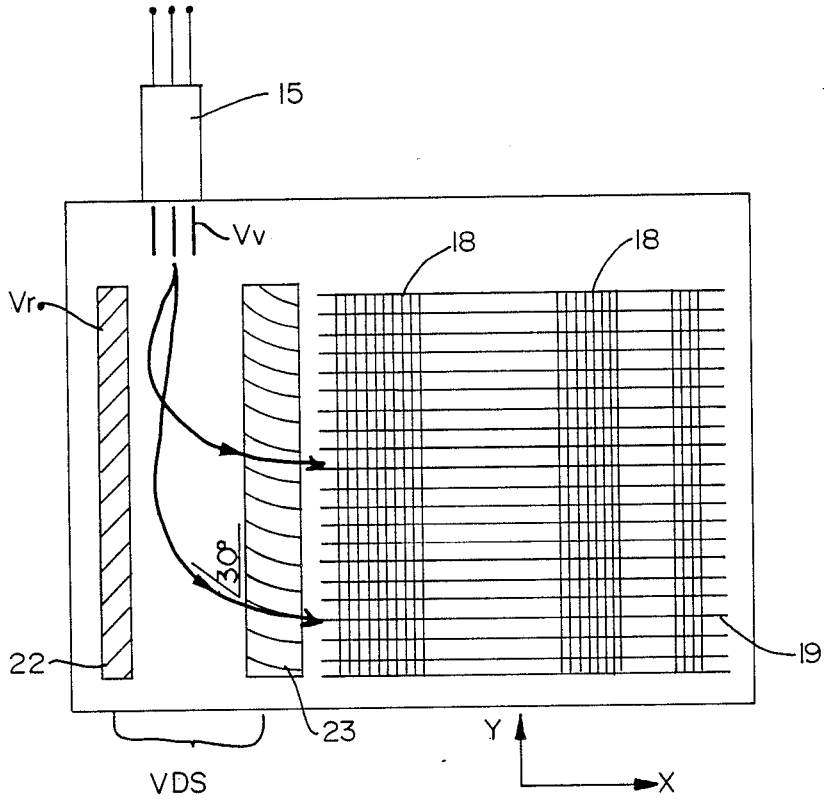
FIG. 2 is a front sectional view illustrating the vertical deflection structure of the flat panel display of FIG. 1.
Figure 3:
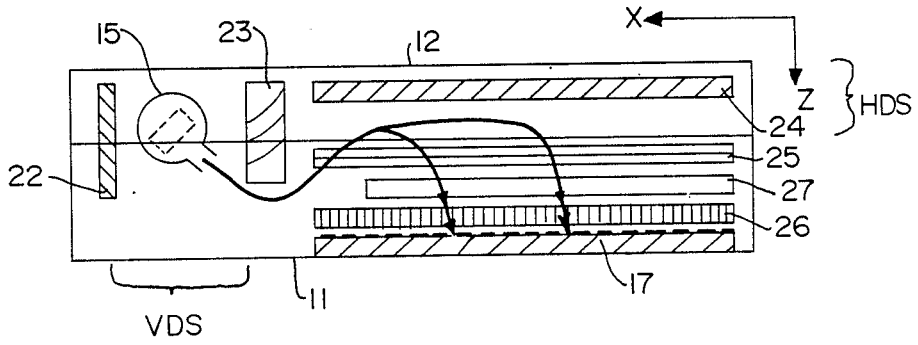
FIG. 3 is a top sectional view illustrating the horizontal deflection structure of the flat panel display of FIG. 1.

As shown more clearly in FIGS. 2 and 3, the angle displacement structure 23 has an array of vanes or passages which receive the beam at incident angles centered around 30 degrees at a series of positions along its vertical length, and turns or displaces the beam through an angle of about 60 degrees so that it exits in the horizontal direction X. The beam is thus scanned by the vertical deflection structure VDS incrementally over the respective horizontal rows of the display. At the same time, the angle displacement structure 27 also turns the beam at an angle in the depthwise direction Z. The preferred incident angle of the beam toward the horizontal deflection plate 24 is also in the range of about 30 degrees. A most favorable incident angle is 30° for the optimum focussing as will be shown in conjunction with FIG. 10.

The vanes of the angle displacement structure 23 can be formed by metallic films evaporatively deposited on an insulative sheet, for example, kapton or mica. Alternatively, the vanes can be formed from a metallic base sheet with an insulation film, such as silicon dioxide, then a second metallic layer formed thereon.

Figure 4:
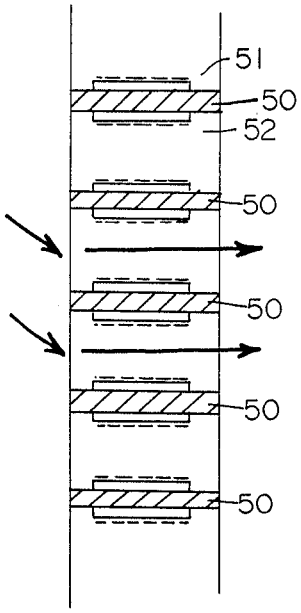
FIG. 4 is a schematic view showing an embodiment of an angle displacement according to the invention.
Figure 5:
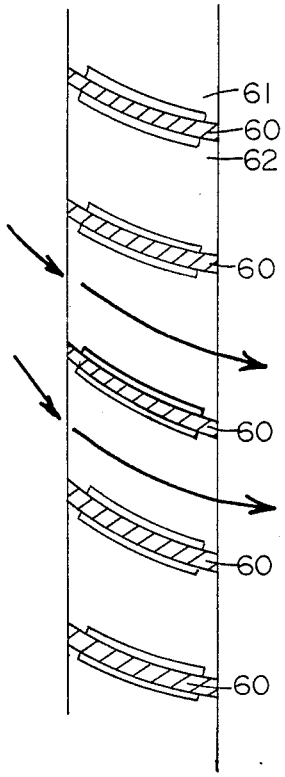
FIG. 5A is schematic view showing another embodiment of an angle displacement structure.
FIG. 5B is a schematic view showing still another embodiment of an angle displacement structure.

In FIG. 4, one version of the VDS angle displacement structure is shown having a series of linear vanes 50 each formed with conductive layers 51, 52 on each side thereof. The layers 51, are biased to the same negative voltage. The electron beam passes in between adjacent pairs of vanes and is guided along the center thereof by the mutual repulsion forces due to the negative biasing of each pair of conductive layers. In FIG. 5, another version of the angle displacement structure has arcuate vanes curving gradually from an entry angle matched to the incident angle of the beam, and an exit angle parallel to the horizontal direction.

Figure 5A:
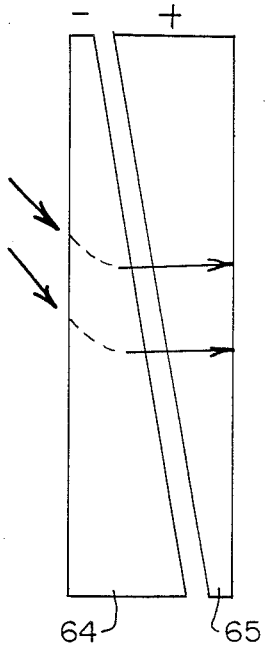

In FIG. 5a there is shown a curved angular displacement plate arrangement consisting of a first plate 64 and a second plate 65. The plates are conductive and tapered with a negative control $v_o$ applied to plate 64 and a more control positive voltage applied to plate 65. The control voltages are varied so the beam (arrow) is bent from the 30° incident angle to a 90° exit angle.

Figure 6:
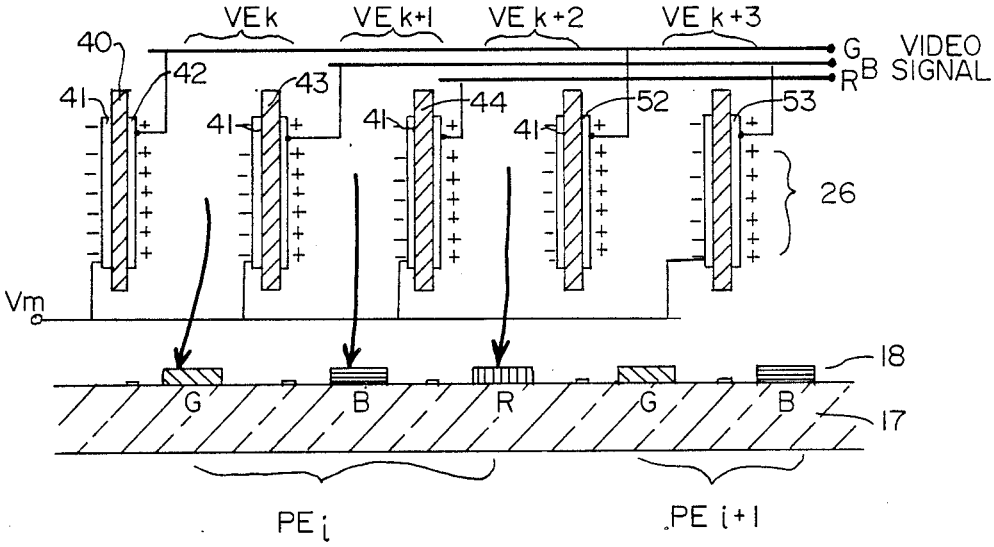
FIG. 6 is a detailed showing a deflection modulation structure according to the invention.

In FIG. 6, a deflection modulation structure 26 is shown having a series vane elements VEk for each horizontal row of picture elements PEi defined in the horizontal direction along the columnar strips of phosphor elements 18 on the screen 17. For color display, three vane elements VE and three phosphor elements R, G, B are associated with each picture element PE. The vane elements are divided by insulative dividers 40 having a conductive layer formed on each side thereof. The dividers are made of an insulative material, such as kapton, ceramic, or silicon dioxide. The conductive layers can be formed by metal vapor deposition. In this embodiment, the conductive layers 41 on one side of the dividers 40 are connected in common to a negative biasing voltage $V_m$. The conductive layers corresponding to each color, for example, layers 42, 52 for red, and 43, 53 for blue, are connected in common to the corresponding color component video signal.

As the electron beam is scanned to each phosphor element of a horizontal line, the beam traverses each corresponding vane element passing between the conductive layers on each pair of adjacent dividers. The voltage level of the color component video signal, relative to the biasing voltage $V_m$ applied to the mesh, determines the electric field established between the two conductive layers, and the beam is deflected in accordance therewith. Thus, the beam can be deflected to any selected portion of a color phosphor element, resulting in emission of light of a corresponding intensity and providing the selected color component illumination level. The combination of three color components R, G, B provides the total color displayed for the associated picture elements. Since the beam is basically the same size as the width of the strip, it will provide maximum illumination to the phosphor when at the center. Any deviation from the center decreases the illumination. The three strips R, G and B are close together to allow integration of the illuminated phosphor by the eye and hence provide the proper color.

The modulation mesh transmits about 60% of the beam, in contrast to a 12% beam transmission in the conventional shadow mask. Thus, the power loss for the modulation mesh is of the order of only a few milliwatts versus tens of watts for the conventional shadow mask.

In the preferred embodiment of the color modulation structure 26, the video signal inputs for the color components are applied directly to the color modulation structure to modulate the color illumination of the picture elements. Each color component input signal is applied to the vane elements of the corresponding color in a row. The beam is scanned to a particular vane element and phosphor element in accordance with the vertical and horizontal synchronization of the video signal. A row timing circuit is used to connect the color component signal input to the each row of vane elements for the phosphor elements currently being scanned. The color modulation structure is preferably biased at a low voltage, e.g. 50 V so that favorable low video signal drives are feasible.

Figure 7:
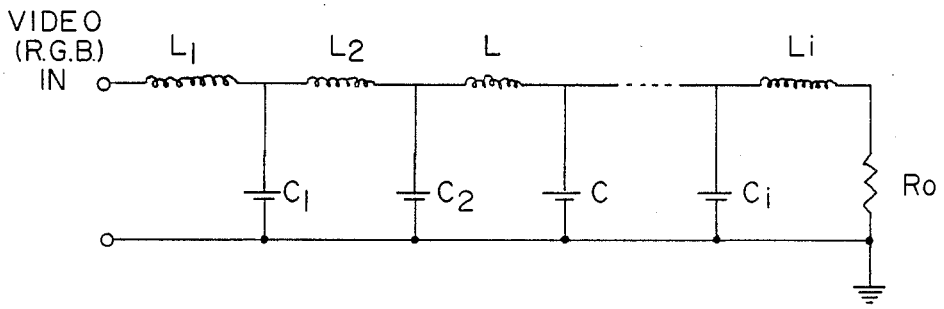
FIG. 7 is a circuit equivalent diagram of the deflection modulation structure.

In accordance with another feature of the invention, the connected vane elements for each color component in a row form a distributed LC equivalent circuit. As shown in FIG. 7, the vane elements have an associated capacitance which is distributed for each horizontal row. For an artificial transmission line of the vane elements, the capacitances of the vane elements looks like a lumped capacitance C. If the vane elements are also formed to have the characteristic of distributed inductances, which looks like a lumped inductance L, then the equivalent impedance $Z_O$ of the transmission line is equal to $\sqrt{L/C}$. By increasing the inductances of the vane elements or by inserting distributed lumped inductances, the equivalent impedance is raised, and the power consumption is reduced. The vane elements can be formed to have a high inductance by evaporating metal layers on ferrite substrates for the deflection modulation mesh.

Figure 8:
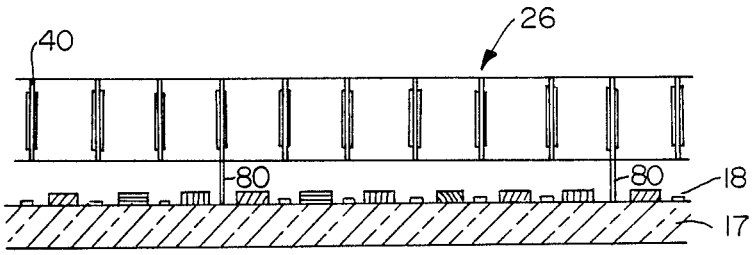
FIG. 8 is a schematic view showing another embodiment of the deflection modulation structure.

In FIG. 8, another embodiment of the deflection modulation mesh is shown having spacers 80 for supporting the mesh structure along the horizontal length of the rows for vacuum supports required in large flat panels.

Figure 9:
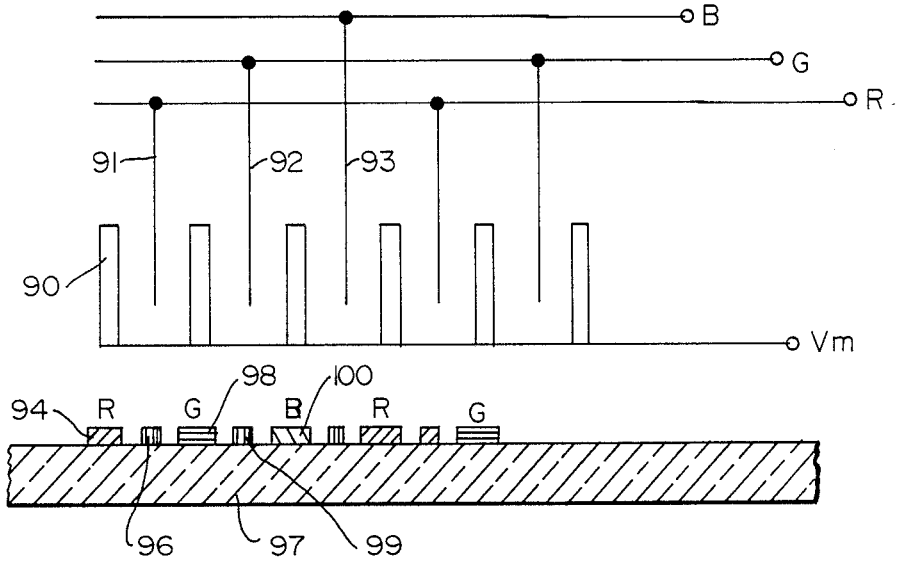
FIG. 9 is an alternate embodiment of a flat panel display according to this invention.

Referring to FIG. 9, there is again shown a general version of the above-noted color tube. As one can ascertain from FIG. 9, there are a series of vanes which are upstanding metal fingers as 90 which are connected to a reference potential $V_M$. This reference potential may, for example, be on the order of +50 volts. In a similar manner, the red, green and blue signals are applied to fingers or metallic strips 91, 92 and 93, as of ex for the red, green and blue phosphor strips 94, 98 and 100. Thus, as one can ascertain, since the R,G,B structures appear as metal tines and the vane structure is located in between, one can have extremely accurate control of the beam. The potential difference between the voltage on the finger 91 and upon the vane 90 will determine the path of the electron beam as for example shown in FIG. 6. Thus, each of the associated phosphor as the red 94, the green 98 and the blue 100, is illuminated according to the position of the beam on the associated phosphor strip. Located, between the phosphor strips are black matrix elements as 96 and 99. These may be formed from black pigmented materials which separate each of the phosphor strips to provide a dark background to enhance the tube contrast.

Figure 10:
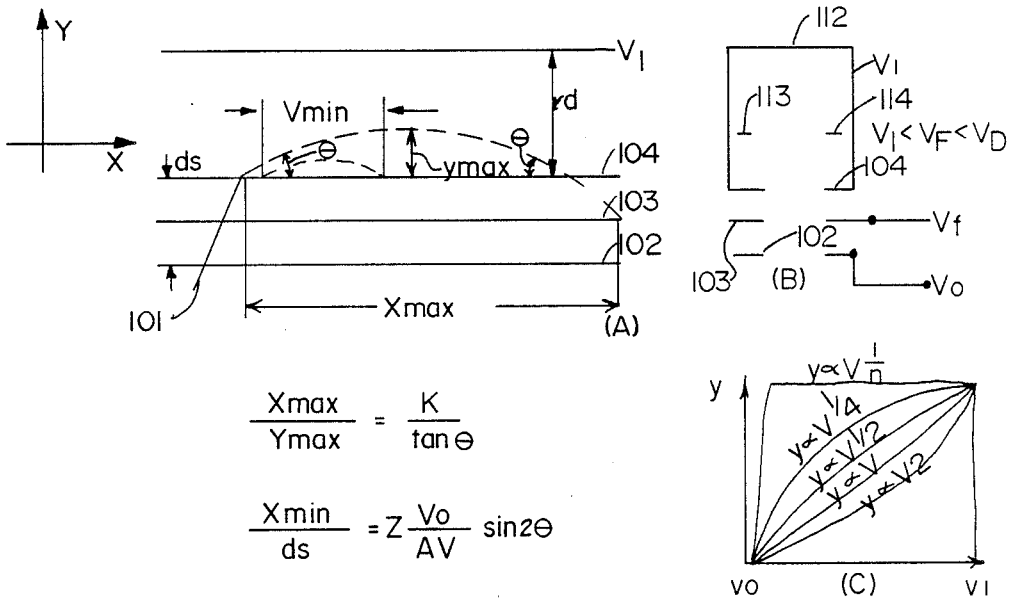
FIG. 10 is a schematic depicting the deflection structure and governing equations.

Referring to FIG. 10, there is shown a deflection arrangement which essentially is employed in the present invention. As seen in FIG. 10, the electron beam 101 is directed through a series of plates, 102, 103. These plates as will be explained are utilized to control focussing. The angle as indicated above is preferably +°. The entire electrode assembly as shown in by reference numeral 15 FIG. 3 is surrounded by a metal enclosure 112 having a potential of V1 applied thereto. Inside the enclosure are focussing electrodes 113 and 114 which can have separate focus potential applied to them. Numeral 104 references the bottom portion of the housing 112 while plate 103 and plate 102 are similarly depicted.

In any event, the equations governing operation of the deflection scheme are given. It is seen that by utilizing this particular deflection mode and particularly looking at the diagram of FIG. 10C, one can ascertain that the deflection in the Y direction can be controlled as a function of N where N is a constant proportional to K as shown in equation 1.

Hence, as one will ascertain, as the value of N increases, the value of K increases. In this manner, the ratio of X maximum to Y maximum increases. Thus, the focussing scheme as shown particularly in FIG. 10 provides a large X to Y ratio which affects the thickness of the tube, and hence it is conceivable to make a half inch thin tube for a 40 inch overall display utilizing deflection techniques shown in FIG. 10. There is also a low scanning voltage drive required as the scanning voltage is proportional to the gap distance $D_S$. As one can ascertain from the equation shown in the figure, $D_S$ can be made extremely small and hence the deflection requires a very small sweep voltage. The most favorable angle of incidence is 30°. Utilizing 30°, one obtains the best focussing condition which can be realized for a thin tube. The focussing is accommodated by the additional transverse focussing plates as 113 and 114 which also may be electrodes or lenses which are well known. Essentially, the voltage relationship among the deflection voltage $V_1$, the focussing voltages $V_{F1}$ and $V_{F2}$, and the beam entrance voltage $V_o$ defines a well-focussed beam during deflection. One can also obtain, utilizing the voltage distribution system shown in FIG. 10C, the various deflection paths.

From the foregoing, it will be understood that the invention provides a flat panel display having a single electron gun and a simplified beam deflection structure which allows incremental ballistic (parabolic) scanning in the vertical and horizontal directions of a screen. The display has a flat envelope configuration, and can be formed in two half-sections which are bonded together. Vertical and horizontal deflections are achieved with a minimum number of parts, and the plural yoke elements, deflection elements, beams, and parallel beam guides of the prior art are avoided. The angle displacement structure and deflection modulation structures can be formed using thin film forming techniques, such as metal vapor deposition.

In addition, the display structure is readily adapted to a full color display. The single electron gun is not modulated, and instead the deflection modulation structure is interposed proximate the screen to more accurately modulate impact position of the beam and, thus, the illumination intensities of the phosphor elements, while also eliminating the conventional shadow mask. The modulation mesh transmits several times more of the beam energy to the screen, thereby greatly reducing the energy waste and thermal dissipation of the conventional shadow mask.

The specific embodiments of the invention described above are intended to be illustrative only, and many other variations and modifications may be made thereto in accordance with the principles of the invention. All such embodiments and variations and modifications thereof are considered to be within the scope of the invention, as defined in the following claims.

I claim:

1. A flat panel display, comprising:

an evacuated display envelope having a relatively flat front wall, a rear wall spaced apart in a depthwise direction from the front wall and substantially coextensive therewith, and lateral sides enclosing the space defined between the front and rear walls, a phosphor screen provided on the inner surface of said front wall substantially in one plane and having a matrix of phosphor elements arranged in horizontal rows and vertical columns disposed over said inner surface of said front wall, an electron gun on one lateral side of the display envelope for providing an electron beam on a first path into the display envelope along a vertical direction substantially parallel to the plane of the screen, vertical deflection means for deflecting said beam over the horizontal rows successively in the vertical direction, said vertical deflection means including an initial deflection plate adjacent said first path of said beam from said electron gun to which incremental deflection voltages are applied for deflection said beam along different incremental trajectories toward said one lateral side of said display envelope, and a vertical reflection plate at said one lateral side of said display envelope which is biased with a voltage for reflecting said beam on said different incremental trajectories toward the respective horizontal rows, horizontal deflection means for deflecting said beam on said different trajectories to sweep across the phosphor elements of the respective horizontal rows, said horizontal deflection means including a horizontal reflection plate disposed toward the rear wall of said display envelope and having a horizontal sweep voltage applied thereto for deflecting said beam toward said phosphor screen disposed at said front wall of said display envelope, and color modulation means interposed between said phosphor screen and said beam as deflected by said horizontal deflection means for controlling said beam to impinge upon selected portions of respective phosphor elements to produce the corresponding illumination intensities.

2. The flat panel display according to claim 1, wherein said matrix of phosphor elements are alternating red, green and blue columns separated by a given distance.

3. The flat panel display according to claim 2, further including black matrix elements located between said separated columns.

4. A flat panel display, comprising:

an evacuated display envelope having a relatively flat front wall, a rear wall spaced apart in a depthwise direction from the front wall, and lateral sides enclosing the space defined between the front and rear walls, a phosphor screen provided on the inner surface of said front wall substantially in one plane and having a matrix of phosphor elements arranged in horizontal rows and vertical columns disposed over said inner surface of said wall, an electron gun for providing an electron beam on a first path into the display envelope, vertical and horizontal deflection means for deflecting said beam in the vertical and horizontal directions from said first path to sweep across the matrix of phosphor elements of said phosphor screen, and color modulation means interposed between said phosphor screen and said beam as deflected for controlling said beam to impinge upon selected portions of respective phosphor elements to produce the corresponding illumination intensities, wherein said color modulation means comprises a mesh structure formed with a plurality of vane elements arranged in a plane, wherein each vane element is disposed in front of a respective one of said phosphor elements, and a modulation control unit which applies selected voltages to said vane elements to establish selected fields between the vanes to deflect said beam to selected positions on said phosphor elements.

5. The flat panel display apparatus according to claim 4, wherein said mesh structure is adapted to receive video signals as the R, G, B signals.

6. The apparatus according to claim 1, wherein said vertical deflection means includes deflecting the beam provided from the electron gun on said first path toward a second lateral wall extending in the vertical direction;

an angle displacement structure having a length extending in the vertical direction spaced from said one lateral side for receiving the reflected beam at a range of respective vertical positions along its length, and for transmitting the electron beam on the second path for a respective one of the horizontal rows of said screen at an angle toward said rear wall of said display envelope;

7. The apparatus according to claim 6, wherein said vertical deflection means electrostatically deflects the beam in the vertical deflection region along parabolically-like curved trajectories so as to be incident at an angle of about 30 degrees at the angle displacement structure, and the angle displacement structure further displaces the beam electrostatically to the horizontal direction.

8. The apparatus according to claim 6, wherein said vertical deflection means electromagnetically deflects the beam in the vertical deflection region along parabolically curved trajectories so as to be incident at an angle of about 30 degrees at the angle displacement structure, and the angle displacement structure further displaces the beam electromagnetically to the horizontal direction.

9. The apparatus according to claim 7, wherein said angle displacement structure comprises:

a series of arcuate vanes in parallel having conductive surface layers which are biased to displace the beam through the desired angles.

10. The apparatus according to claim 8, wherein said angle displacement structure comprises:

a series of arcuate vanes in parallel having conductive surface layers which are biased to displace the beam through the desired angles.

11. The apparatus according to claim 5 wherein incremental sweep voltages synchronized with the video signal are applied to the vertical and horizontal deflection means, respectively, to scan the beam to the horizontal rows and to the phosphor elements of each horizontal row.

12. The apparatus according to claim 1, wherein said color modulation means is biased at a voltage of about 50 volts.

13. The apparatus according to claim 8, further including a cylindrical horse-shoe magnet surrounding said beam.

* * * * *